United States Patent [19]

Safar et al.

[11] Patent Number: 4,699,327

[45] Date of Patent: Oct. 13, 1987

[54] DEVICE FOR WINDING CONICAL YARN PACKAGES

[75] Inventors: Vaclav Safar; Jindrich Lukes, both of Liberec; Ales Pleskot, Mseno n/Nisou, all of Czechoslovakia

[73] Assignee: Elltex, koncern textilniho strojirenstvi, Liberec, Czechoslovakia

[21] Appl. No.: 834,915

[22] Filed: Feb. 28, 1986

Related U.S. Application Data

[63] Continuation-in-part of Ser. No. 654,206, Sep. 24, 1984, abandoned.

[30] Foreign Application Priority Data

Sep. 22, 1983 [CS] Czechoslovakia ..... PV 6905-83

[51] Int. Cl.[4] ..... B65H 54/42; B65H 54/46

[52] U.S. Cl. ..... 242/18 DD; 242/35.5 R

[58] Field of Search ..... 242/18 DD, 18 R, 18.1, 242/45, 35.5 R

[56] References Cited

U.S. PATENT DOCUMENTS

| | | | |
|---|---|---|---|
| 4,002,306 | 1/1977 | Raasch | 242/18 DD X |
| 4,089,480 | 5/1978 | Kamp | 242/18 DD |
| 4,113,193 | 9/1978 | Raasch et al. | 242/18 DD X |
| 4,138,071 | 2/1979 | Schewe | 242/18 DD |

FOREIGN PATENT DOCUMENTS

| | | | |
|---|---|---|---|
| 2403341 | 7/1975 | Fed. Rep. of Germany | 242/18 DD |
| 2718486 | 11/1978 | Fed. Rep. of Germany | 242/18 DD |
| 2721972 | 11/1978 | Fed. Rep. of Germany | 242/18 DD |
| 1119002 | 3/1956 | France | 242/18 DD |
| 31254 | 10/1970 | Japan | 242/18 DD |
| 782917 | 9/1957 | United Kingdom | 242/18 DD |

*Primary Examiner*—Stanely N. Gilreath

[57] ABSTRACT

A device for winding conical yarn packages, particularly in textile machines with a constant yarn delivery speed, which eliminates the difference between the yarn delivery speed and the yarn winding speed by using a prolate spheroid drive means for the yarn package. The drive means is supported on a common shaft by means of a tilting joint and a carrier there being a swinging actuator associated with at least one end face of the drive means, the swinging motion of the actuator taking place within a plane passing through the axis of the common shaft.

9 Claims, 4 Drawing Figures

DEVICE FOR WINDING CONICAL YARN PACKAGES

This application is a continuation-in-part application of Ser. No. 654,206, filed Sept. 24, 1984, now abandoned.

The present invention relates to a device for winding conical yarn packages particularly in textile machines, and mainly open-end spinning machines, with a constant yarn delivery speed. Such device comprises for each package a barrel-shaped drive means, supported on a common shaft, with which the package is in driving engagement with its zone of frictional contact; said zone is periodically displaced along the length of the package in dependence on the displacement of the run-on point of the yarn on the package as it comes from a traversing yarn guide.

For winding conical yarn packages in textile machines with a constant delivery speed of the yarn to the winding mechanism, particularly for the winding of yarn in open-end spinning machines, various means are usually employed to compensate for variations occurring periodically in the winding of the yarn on the varying diameter along the conical package. In order to compensate for the thus occurring variations, various storage devices or yarn length compensators are employed, which operate synchronously with the motion of the yarn guide or, in other cases, independently of the motion or position thereof.

Another problem in the winding of conical yarn packages resides in removing slippage of the package relative to the driving roller hich is produced by a difference in the circumferential velocities on the large and small diameters of the package. Said problem has been previously removed by the use of a prolate spheriod means and by tilting the package, so that the package is in frictional contact with said drive means only within a narrow zone thereof. However, such arrangement has not solved the problem of the variations in the winding speed relative to the yarn delivery speed. Therefore, with similar devices, various compensating measures for the trajectory of the delivered yarn have been resorted to, for example, in such a manner that during winding, in the course of one tilting period of the package or in the course of one traverse stroke of the yarn, a phase shift is introduced between the run-on point of the yarn and said narrow strip of frictional contact, such phase shift involving either acceleration or delay of the run-on point of the yarn relative to the area of said frictional contact. Under these conditions, however, the winding of the yarn does not proceed quite reliably, since an uncontrollable tightening or slackening of the individual convolution of yarn on the package, or the incorrect laying thereof, and the like, may occur.

The mechanisms for winding yarn in the form of a conical package, based on the known above-described methods, are usually complicated and technically exacting.

The object of the device according to the present invention is to remove or substantially mitigate the disadvantages of the existing known devices for winding conical yarn packages. The gist of the invention resides in that a drive means is supported on a common shaft by means of a tilting joint provided with a carrier, and that associated with at least one face or end of the driving means there is an actuator swinging within a plane passing through the axis of the common shaft.

The solution according to the invention can technically be easily realized and is simpler than other known devices serving the same purpose, from the point of view of both its construction and its manufacture. This advantage makes itself felt particularly in open-end spinning machines with a central yarn take-up traverse mechanism.

Examples of the device for winding conical yarn packages in accordance with the invention are diagrammatically shown in the accompanying drawing, in which.

Figure 1:
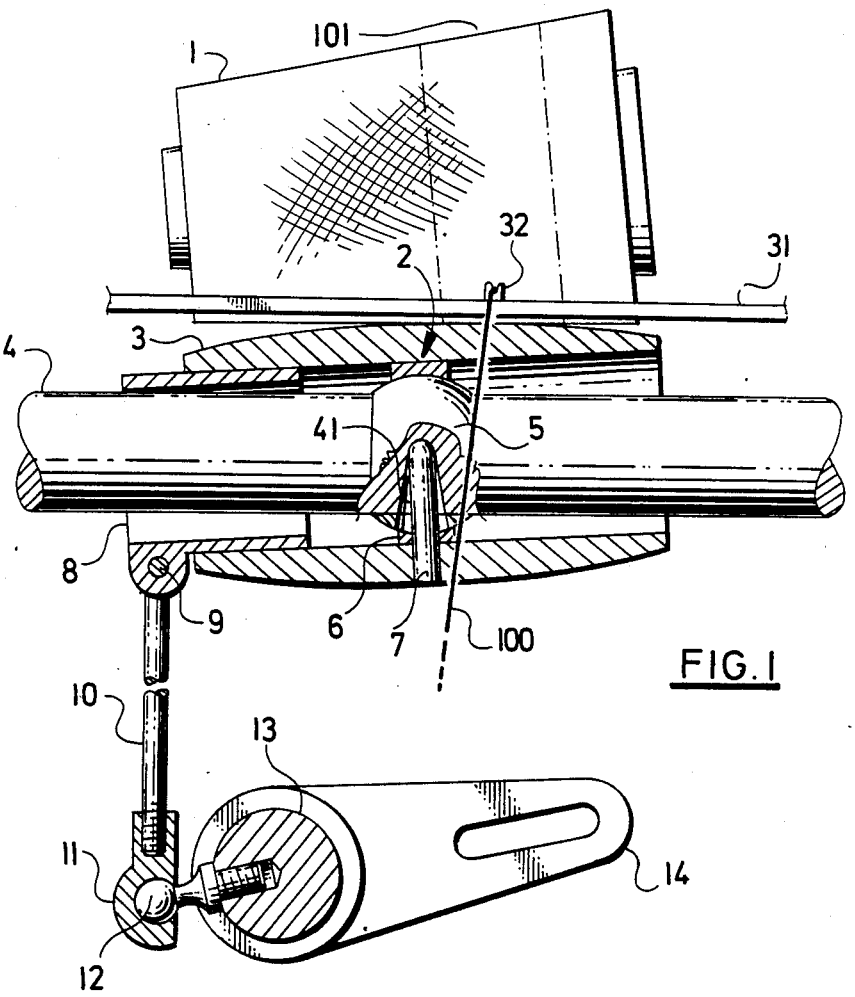
FIG. 1 is a longitudinal section through a drive means with a swing sleeve of an actuator and a tilting joint.
Figure 4:
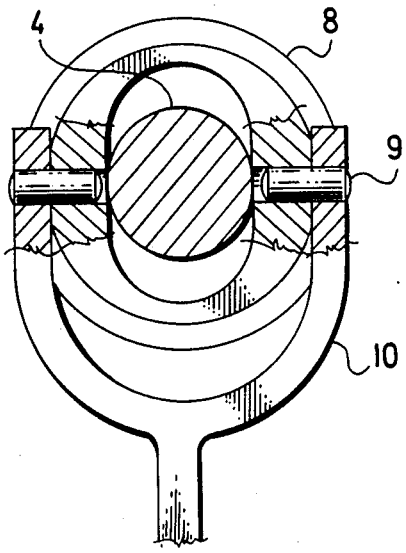
FIG. 4 is a cross-sectional view of a swing sleeve of an actuator.

Turning first to FIG. 1, a conical yarn package 1 bears with its zone 101 of frictional contact on a prolate spheriod means 3 which is supported by means of a tilting joint 2 on a common drive shaft 4. The tilting joint 2 is provided with spherical sliding surfaces formed on its inner ring 5 which is fitted on the common shaft 4, and within an outer ring 6 which in turn is secured within a cavity of the drive means 3. A driving connection of the drive means 3 to the common drive shaft 4 is further effected by means of a carrier 7 having the form of a pin which extends into a recess 41 in the common shaft 4. The recess 41 permits the carrier 7 to swing within the plane of the axis of the common shaft 4. Within the cavity of the drive means 3 there is further slidably mounted a swing sleeve 8 of an actuator the inner opening of said sleeve 8 having an oval form and its walls extending in the direction of the longitudinal axis of the oval are in frictional contact with the common shaft 4 thus serving to ensure flatness of the swinging motion of the drive means 3. Such structure is shown in FIG. 4. The swing sleeve 8 of the actuator is connected by means of a pin 9 of an adjustable, e.g. by means of threads at its lower end, pull rod 10, an articulated casing 11, and a spherical journal 12 to an oscillating auxiliary shaft 13 extending along the machine parallel with the common shaft 4. In FIG. 1 the auxiliary shaft 13 is shown in a position rotated through 90° to a terminal position from another terminal position, not shown. Mounted on the auxiliary shaft 13 there is a control lever 14 which transmits the swinging motion of shaft 13 synchronously with the motion of a traverse guide 32 for yarn 100. The relationship between the common shaft 4 and the swing sleeve 8 of the actuator is shown in FIG. 4.

Figure 2:
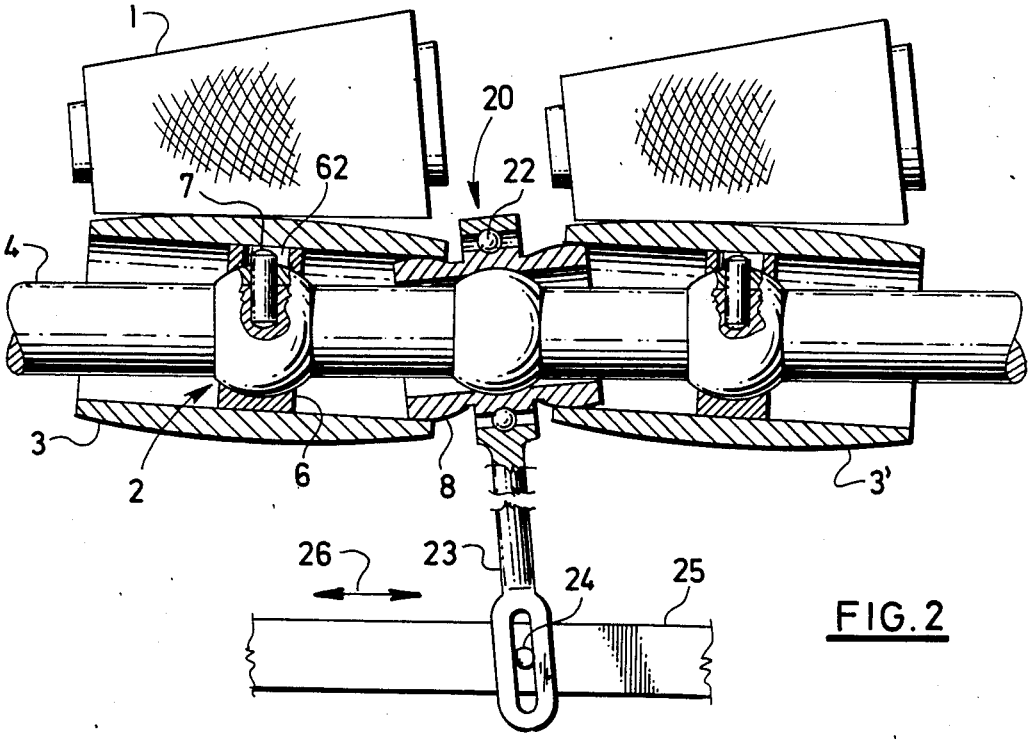
FIG. 2 is a view of a disposition of an actuator for two drive means disposed in a side-by-side relation.

In the embodiment of FIG. 2, the conical yarn package 1 bears on the prolate spheriod drive means 3 which is supported by means of the tilting joint 2 on the common shaft 4. On the common shaft 4 there is fixedly inserted a carrier 7 having the form of a pin, which partly extends into a groove 62 in the outer ring 6 oriented longitudinally of the axis of the common shaft 4. On the common shaft 4, intermediate the two similar drive means 3, 3', there is an articulated seat 20 for the actuator having the form of a swing body 21 which is provided, in the central portion, on the periphery thereof, with a groove receiving balls 22 of a ball bearing arrangement for a control lever 23, the lower extremity of which is provided with a slot into which there engages a pin 24 secured on a pull rod 25 extending along the machine parallel with the axis of the common shaft 4. The pull rod 25 is connected to a mechanism (not shown) which is kinematically linked to the traverse yarn guide 32 and performs a longitudinal back and forth movement in the direction of the double-headed arrow 26. The opposite ends of the swinging body 21 of the actuator extend into two cavities of two adjacent means 3, 3' and rotates together with them.

Figure 3:
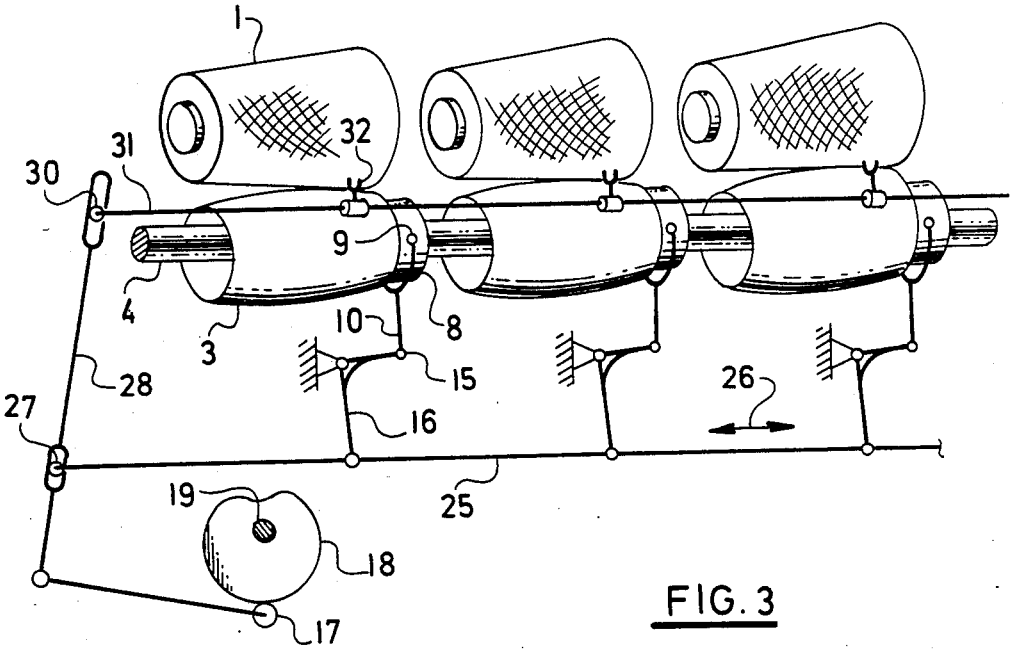
FIG. 3 is a view of drive means, indicating a kinematic linkage of their actuators to a plurality of traverse yarn guides.

In the embodiment shown in FIG. 3, a plurality of conical yarn packages 1 are mounted in bobbin holders (not shown). The packages 1 bear on the drive means 3, each of which is supported by means of one of the described articulated connections on the common shaft 4. Extending into the cavity or inner opening of each of the drive means 3 there is an actuator connected by means of the pin 9, pull rod 10, a joint 15 and an angular lever 16 to the pull rod 25 extending along the machine, in parallel with the axis of the common shaft 4. The pull rod 25 performs a longitudinal back and forth movement in the direction of the double-headed arrow 26 and is kinematically connected by means of a pin 27 to a two-armed lever 28, a follower 17 of which engages a cam 18 fixed on a shaft 19. At the same time, the two-armed lever 28 is kinematically connected by means of a pin 30 to a continuous traverse rail 31 extending along the machine and on which the traverse yarn guides 32 are disposed.

The operation of the above described device is as follows: Due to the rotation of the drive means 3, a rotary motion is imparted to the package 1 to be wound. The drive means 3 on the common shaft 4 is tilted in such manner that the zone 101 of friction contact is displaced synchronously with the movement of the guide 32 for the yarn 100 being wound. The synchronization of movement s of the yarn guide 32 and the zone 101 ensures that the yarn 100 is wound at a substantially constant winding speed, since the active radius of the drive means 3 within the zone 101 of friction contact is substantially at a constant distance from the axis f the shaft 4 throughout the course of tilting of the drive means 3. Synchronization of these movements can be carried out within an adjustable range according the winding conditions of the yarn, for example, in accordance with the fineness of the the yarn 100, the winding speed, the conicity of the yarn package 1, and the like.

The drive means 3 is supported on the common shaft 4 by means of the tilting joint 2, while the carrier 7 prevents the drive means 3 from angular displacement relative to the common shaft 4, whereby rotation of the drive means 3 is ensured.

The swinging motion of the drive means 3 is derived from mechanisms which impart movement to the traverse guide 32 for the yarn 100. It has proved advantageous to provide a direct connection to the drive shaft 19 supporting the cam 18 for driving the traverse rail 31. Flatness of the swinging motion of the drive means 3 is ensured in that the swing sleeve 8 of the actuator is guided by the shaft 4, as shown in FIG. 4. The swinging motion of the drive means 3 is produced by the actuator in a transverse direction i.e. substantially normal direction within a plane which passes through the zone 101 of frictional contact between the drive means 3 and the yarn package 1. The device as shown in FIG. 2 is designed for the control of two adjacent drive means 3, 3' by a single control mechanism. Here, the flatness of the tilting motion of the drive means 3, 3' is ensured by the flatness of the swinging motion of the lever 23. The lever 23 is mounted on the swing body 21 by means of the balls 22 of the ball bearing arrangement.

For a correct winding operation, it is important to optimalize the profile of the prolate spheriod curvature of the drive means 3, as well as its basic position and the magnitude of its swing. To this end, the basic position is adjustable by an adjusting means either centrally, for example, by adjusting the length of the pull rod 25 according to FIG. 3, or individually by adjusting the length of the pull rod 10. The magnitude of the swing can easily be changed by a corresponding positioning of the pins of the pull rod 25 in the guide slot of the lever 28, 23.

In view of the fact that with a constant winding speed the package 1 to be wound rotates at a periodically variable speed, it has proved advantageous to provide the surface of the entire drive means 3 with a layer having a high coefficient of friction and a high abrasion resistance.

The devices as illustrated are only exemplary embodiments, he constructional solution of which can be modified by a number of other variants within the scope of the invention. Particularly it is possible to interpose a rolling bearing arrangement between the drive means 3 and the swing sleeve 8 of the actuator in order to increase the service life of the device.

It is also possible and easily realizable to control the swinging motion of the drive means 3 by means of rollers which support it at its lower side and are mounted in a swing frame, the motion of which is synchronous with the motion of the traverse rail 31.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. In a device for winding conical yarn packages adapted for use in textile machine with a constant yarn delivery speed, having, for each package, a prolate spheroid drive means having a zone of frictional contact supported on a common shaft, the package being in driving engagement with the zone of frictional contact of the prolate spheroid driving means, a traverse yarn guide positioned above the prolate spheroid drive means for guiding yarn, the improvement wherein the drive means is supported on the common shaft by means of a tilting joint and a carrier, means for traversing the yarn guide whereby a run on point for the yarn is displaced axially on the face of the package, and a swing actuator connected to one end of the drive means for shifting the zone of frictional contact and for adjusting and periodically displacing said zone of the drive means along the length of the package in dependence on the displacement of the run-on point of the yarn on the package as the yarn comes from the traverse yarn guide.

2. A device as claimed in claim 1 comprising a control mechanism synchronized with said traverse yarn guide, said swing actuator includes a non-rotating swing sleeve extending from the side of an end face of the drive means into a cavity thereof, and means for connecting said swing sleeve to said control mechanism.

3. A device as claimed in claim 2 wherein the swing sleeve of the actuator is mounted in a cavity of the drive means by means of a bearing arrangement.

4. A device as claimed in claim 2, wherein the swing sleeve of the actuator is mounted in a cavity of the drive means by means of a rolling bearing arrangement.

5. A device as claimed in claim 2, wherein the swing sleeve of the actuator is mounted in a cavity of the drive means by means of a sliding bearing arrangement.

6. A device as claimed in claim 5, comprising an articulated connection of the swing sleeve of the actuator to the control mechanism, and adjusting means provided in the articulated connection for adjusting the position and magnitude of swing of said swing sleeve to provide a correct winding operation.

7. A device as claimed in claim 1, wherein the carrier of the tilting joint is constituted by a pin penetrating through said tilting joint into a recess in the common shaft, the tilting joint having two concentrically disposed spherical sliding rings surrounding the common shaft, the pin being pivotally mounted in a groove in one of the rings of the tilting joint.

8. A device as claimed in claim 1, wherein the actuator is connected to one end of two adjacent drive means.

9. A device as claimed in claim 2, comprising an articulated connection of the swing sleeve of the actuator to the control mechanism, and adjusting means provided in the articulated connection for adjusting the position and magnitude of swing of said swing sleeve to provide a correct winding operation.

* * * * *